US006708511B2

(12) United States Patent
Martin

(10) Patent No.: US 6,708,511 B2
(45) Date of Patent: Mar. 23, 2004

(54) COOLING DEVICE WITH SUBCOOLING SYSTEM

(75) Inventor: Jon Scott Martin, Conyers, GA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/218,123

(22) Filed: Aug. 13, 2002

(65) Prior Publication Data

US 2004/0031278 A1 Feb. 19, 2004

(51) Int. Cl.[7] ..... F25D 17/02; F25B 27/00

(52) U.S. Cl. ..... 62/201; 62/238.6

(58) Field of Search ..... 62/201, 238.6, 62/238.1, 115, 183

(56) References Cited

U.S. PATENT DOCUMENTS

| | | | | |
|---|---|---|---|---|
| 2,102,940 | A | | 12/1937 | Buchanan |
| 3,188,829 | A | | 6/1965 | Siewert et al. |
| 3,498,072 | A | | 3/1970 | Stiefel |
| 3,976,123 | A | | 8/1976 | Davies |
| 3,986,664 | A | | 10/1976 | Gustafsson |
| 4,012,920 | A | | 3/1977 | Kirschbaum |
| 4,019,679 | A | | 4/1977 | Vogt et al. |
| 4,041,724 | A | | 8/1977 | Gustafsson |
| 4,049,045 | A | | 9/1977 | Moog et al. |
| 4,141,222 | A | | 2/1979 | Ritchie |
| 4,238,933 | A | | 12/1980 | Coombs |
| 4,305,456 | A | | 12/1981 | Mueller et al. |
| 4,553,401 | A | | 11/1985 | Fisher |
| 4,680,941 | A | * | 7/1987 | Richardson et al. ..... 62/184 |
| 4,751,823 | A | | 6/1988 | Hans |
| 5,014,770 | A | | 5/1991 | Palmer |
| 5,050,394 | A | | 9/1991 | Dudley et al. |
| 5,050,396 | A | | 9/1991 | Ohkoshi et al. |
| 5,054,542 | A | | 10/1991 | Young et al. |
| 5,596,878 | A | | 1/1997 | Hanson et al. |
| 5,802,860 | A | | 9/1998 | Barrows |
| 5,984,198 | A | | 11/1999 | Bennett et al. |
| 6,378,318 | B1 | * | 4/2002 | Jin ..... 62/238.7 |
| 6,378,323 | B1 | | 4/2002 | Chavagnat |
| 6,385,985 | B1 | | 5/2002 | Bussjager et al. |
| 2003/0011289 | A1 | | 1/2003 | Adams et al. |

FOREIGN PATENT DOCUMENTS

| | | |
|---|---|---|
| DE | 3108139 A1 | 9/1982 |
| JP | 58-69340 | 4/1983 |
| JP | 60-165457 | 8/1985 |
| JP | 60-165458 | 8/1985 |

* cited by examiner

*Primary Examiner*—Chen Wen Jiang
(74) *Attorney, Agent, or Firm*—Foley & Lardner

(57) ABSTRACT

A cooling device with a subcooling system is disclosed, where the cooling device has a closed loop refrigerant cycle containing a refrigerant, including a heat exchanger communicating with the closed loop refrigerant cycle and communicating with a fluid, the heat exchanger configured to selectively receive and cool the refrigerant from the closed loop refrigerant cycle when the refrigerant temperature is greater than the coolant temperature; and a fluid receiving device configured to receive the fluid that is warmed in the heat exchanger.

A modular system for providing a refrigerant to a cooling device at an installation location is also disclosed and includes a transportable enclosure having at least one compressor, a condenser and a piping system for conveying the refrigerant in a closed loop cycle, where the piping system includes portions configured to be coupled to the cooling device at the installation location.

19 Claims, 4 Drawing Sheets

COOLING DEVICE WITH SUBCOOLING SYSTEM

FIELD OF THE INVENTION

The present invention relates to a cooling device. The present invention relates more particularly to a cooling device having a subcooling system.

BACKGROUND

It is well known to provide a cooling device such as a refrigerator, freezer, temperature controlled case, air conditioner, etc. that may be used in commercial, institutional and residential applications for storing refrigerated or frozen objects, or for providing cooling or air conditioning. Such known cooling devices often include a closed loop vapor expansion refrigeration cycle having a compressor, condenser, expansion device and an evaporator for transferring heat from an area or object to be cooled to a heat sink. In such known cooling devices, a condenser is provided to cool the compressed refrigerant, where it may then be expanded to a low temperature condition for absorbing heat in the evaporator. However, operational efficiencies in thermal performance of the cooling device may be realized by subcooling the liquid refrigerant before expansion to increase the heat absorption capability of the refrigerant in the evaporator.

In such known condensers for cooling systems, it is generally known to recover the waste heat in the condenser by circulating air or water to the condenser where the heat from the refrigerant warms the air or water, which may then be used in other applications such as heating an air supply or providing a source of hot water. However, these heat recovery applications are often limited to specific devices, such as heaters, radiators, defrost systems for the particular cooling device, etc. having fixed equipment located close to the cooling devices.

Accordingly, it would be advantageous to provide a cooling device with a subcooling system to improve the thermal performance of the cooling device. It would also be advantageous to provide a cooling device with a subcooling system that provides subcooling when a coolant is available and may be operated without subcooling when a coolant is unavailable. It would also be advantageous to provide a cooling device having a subcooling system that uses a readily available coolant, where the coolant can then be used as a source of heat in other applications. It would be further advantageous to provide a cooling device having a subcooling system that is portable and adaptable for use in a variety of locations.

Accordingly, it would be advantageous to provide a refrigeration device with a subcooling system having any one or more of these or other advantageous features.

SUMMARY

Figure 1A:
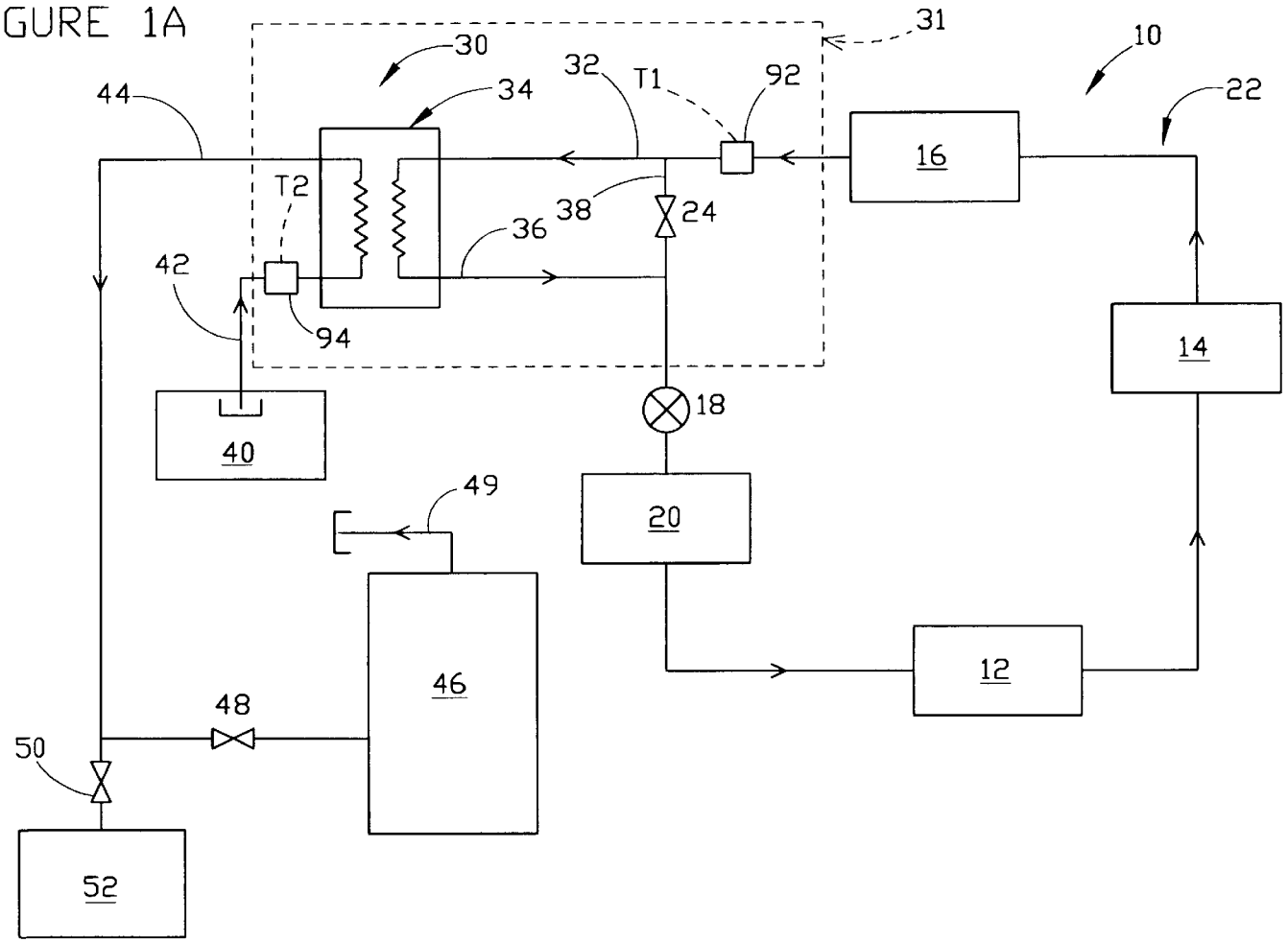
FIG. 1A is a schematic drawing of a cooling device with a subcooling system according to a preferred embodiment.

The present invention relates to a cooling device with a subcooling system, where the cooling device has a closed loop refrigerant cycle containing a refrigerant, including a heat exchanger communicating with the closed loop refrigerant cycle and communicating with a fluid, the heat exchanger configured to receive and cool the refrigerant from the closed loop refrigerant cycle when the refrigerant temperature is greater than the fluid temperature; and a fluid receiving device configured to receive the fluid that is warmed in the heat exchange interface.

The present invention also relates to a method of subcooling a refrigerant in a cooling device having a closed loop cooling cycle, where the method includes connecting a heat exchanger to a condensed liquid refrigerant portion of the closed loop cooling cycle, providing a fluid from a fluid source in thermal communication with the heat exchanger, directing the refrigerant to the heat exchanger to cool the refrigerant and warm the fluid when the refrigerant temperature is greater than the fluid temperature, bypassing the refrigerant away from the heat exchanger when the refrigerant temperature is less than the fluid temperature, and routing the fluid from the heat exchanger to a fluid receiving device.

The present invention further relates to a cooling system having a subcooling device, with the cooling system having a refrigerant in a closed loop refrigeration cycle. A heat exchanger having a refrigerant inlet is configured to receive the refrigerant from the closed loop refrigeration cycle and a refrigerant outlet is configured to return the refrigerant in a cooled state to the closed loop refrigeration cycle. The heat exchanger further includes a fluid inlet configured to receive a fluid from a fluid source and a fluid outlet configured to discharge the fluid in a warmed state to a warm fluid usage application. A control system is also provided to direct the refrigerant through the heat exchanger when the refrigerant temperature at the refrigerant inlet is greater than the fluid temperature at the fluid inlet and to bypass the refrigerant around the heat exchanger when the refrigerant temperature is less than the coolant temperature.

The present invention also relates to a modular system for providing a refrigerant to a cooling device at an installation location, including a transportable enclosure having at least one compressor, a condenser and an interconnecting piping system for conveying the refrigerant in a closed loop cycle, where the piping system includes portions configured to be coupled to the cooling device at the installation location.

The present invention further relates to a modular subcooling unit adapted for use with a cooling device for subcooling a refrigerant and includes a heat exchanger adapted to selectively receive the refrigerant and adapted to receive a fluid, and a valve configured to direct the refrigerant to the heat exchanger when the valve is in a first position and to direct the refrigerant away from the heat exchanger when the valve is in a second position, and a control system configured to control the operation of the valve between the first position and the second position.

DETAILED DESCRIPTION OF THE PREFERRED EMBODIMENTS

Referring to FIG. 1A, a cooling device having a subcooling system is shown according to a preferred embodiment. Cooling device 10 (e.g. refrigerator, freezer, walk-in cooler, temperature-controlled case, air conditioner, chiller, etc.) includes the following conventional components: one or more compressors 12, a condenser 14, an expansion device 18, an evaporator 20 and a refrigerant piping system 22 made of copper or other suitable material and interconnecting the components for conveying a vapor expansion refrigerant such as R-22, R-507 or R-404A in a closed-loop cycle. The cooling device may include other conventional components such as filters, dryers, oil separators, regulators, valves, sight glasses, etc. (not shown) that are suitable for a particular cooling system. In an alternative embodiment, the cooling device 10 may also include a receiver tank 16, for applications where a receiver tank is desirable. The refrigerant in evaporator 20 receives heat from spaces or objects (not shown) to be cooled during the evaporation portion of the cycle and is then routed to compressor 12 where it is compressed to a high pressure and temperature state in the compression portion of the cycle. The refrigerant is routed to the condenser 14 where it is condensed to an approximate saturated liquid state and then received in receiver tank 16 (if provided).

The refrigerant leaving the condenser 14 and receiver 16 (if provided) is then expanded to a low pressure and temperature, saturated liquid and vapor mixture for use in the evaporator 20 to remove heat from an area or object to be cooled. The efficiency of the cooling system can be increased by subcooling the refrigerant. The use of a subcooler after the condensing operation may place the refrigerant in a saturated liquid state if not completely condensed in the condenser, and/or may lower the refrigerant temperature below its saturated liquid temperature to increase the relative percentage of saturated liquid resulting after the expansion process.

In a mode of operation without subcooling, the refrigerant may be routed through a valve 24 (e.g. solenoid valve, manual valve, etc.) directly to expansion device (e.g. throttle valve, capillary tube, etc.) for expansion to a low temperature state where it is available for removing heat in evaporator 20 to complete the cycle. In a mode of operation with subcooling, the refrigerant may be routed to a subcooling system 30 by closing valve 24 and directing the refrigerant through a subcooling supply line 32 to a subcooler 34 to subcool the refrigerant. The subcooled refrigerant leaving subcooler 34 may then be routed through subcooler return line 36 to expansion device 18.

Figure 2A:
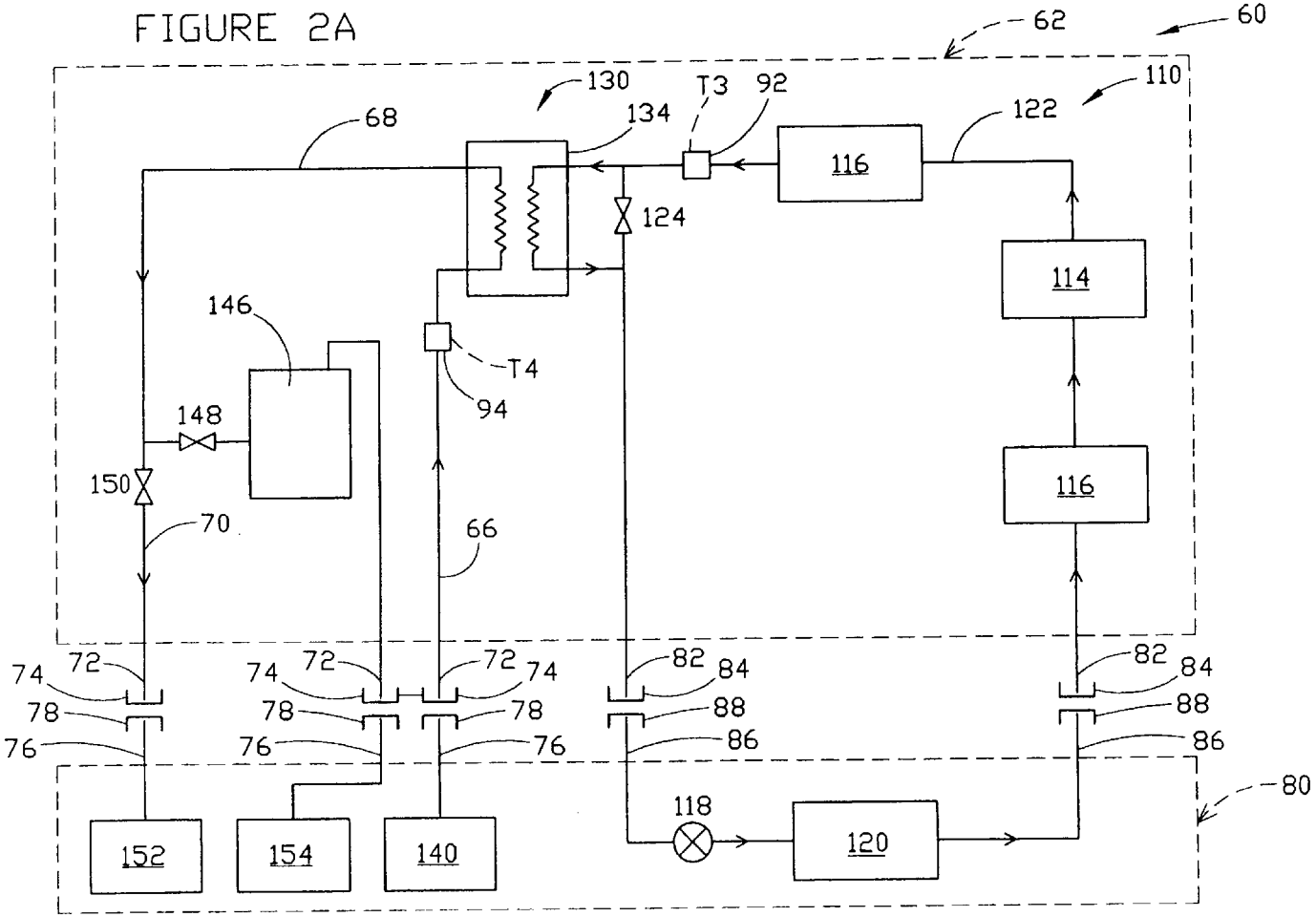
FIG. 2A is a schematic drawing of a cooling device with a subcooling system according to another preferred embodiment.

The cooling device with subcooling system may be provided as a complete system (as shown in FIG. 1A), or may be provided as a generally self-contained modular unit for tie-in to a cooling device, or may further be provided as a modular system (as shown in FIG. 2A) capable of use at a desired installation location having a cooling device. In such applications, subcooling system 30 may be used to recover heat from the refrigerant for use in other applications where the availability of such heat is desirable or tolerable.

Referring further to FIG. 1A, the subcooling system is shown according to a preferred embodiment. Subcooling system 30 includes subcooler 34 provided between receiver 16 (if provided) or condenser 14 and expansion device 18 and includes a bypass line 38 that includes valve 24. In a particularly preferred embodiment, subcooler 34 is a plate-type heat exchanger and includes inlet and outlet connections for both the refrigerant and a coolant in a counter-flow relation. The coolant is provided to subcooler 34 from a coolant source 40 through a coolant supply line 42, where the coolant may be any steady flow or intermittent flow source of water or other coolant (e.g. a secondary loop liquid coolant for other devices such as a refrigeration device having both a primary vapor expanision loop and a secondary liquid cooling loop, etc.) having a temperature below the saturated liquid temperature of the refrigerant. When the coolant flow is available and has a temperature below the temperature of the liquid refrigerant, valve 24 closes and the liquid refrigerant is routed through subcooler 34, and the subcooled refrigerant is then routed to expansion device 18 for expansion and use in evaporator 20 for cooling an area or object to be cooled. In an alternative embodiment, the subcooler can use any type of heat exchange device using any flow orientation.

In a particularly preferred embodiment, the coolant source 40 is a water supply such as a municipal, commercial, agricultural, residential or other supply source of relatively cold water. The coolant temperature increases as it travels through subcooler 34 and the warmed coolant that is discharged from subcooler 34 through subcooler discharge line 44 is then available for use in applications where a warm water supply is either desirable or tolerable. In a particularly preferred embodiment, the warmed coolant may be routed through a valve 48 to provide a supply of preheated water to a hot water device 46 (e.g. boiler, hot water heater, radiator, baseboard heaters, etc.) to provide a source 49 of hot water or steam. The warmed coolant may also be used for other applications, for example, valve 48 may be closed and valve 50 may be opened to direct the warmed coolant to other applications 52 where warm water is desirable, including, but not limited to, filling swimming pools, water theme parks, etc. or where warm water is tolerable, such as irrigating crops, plants or other agricultural products, watering lawns or landscapes, etc. According to other embodiments, subcooling system 30 may be used in applications 52 where a cooling device is used in a location where a water supply is required and warming of the water is either desirable or tolerable for its intended uses.

The coolant source 40 may involve applications where the coolant flow is intermittent, such as home or other residential uses, or where the coolant flow is generally steady or continuous such as commercial, industrial or agricultural uses. Where the application involves intermittent coolant flow rates, the coolant supply for subcooling is available whenever sufficient flow exists to maintain the coolant temperature at subcooler 34 below the liquid refrigerant saturation temperature, and improvements in thermal performance of cooling device 10 are available corresponding to the availability of coolant flow. Where the application involves a generally continuous or steady flow, the improvement in thermal performance of cooling device 10 is correspondingly increased. Accordingly, subcooling system 30 is capable of providing incremental thermal performance benefit in applications having low cooling demand or intermittent coolant flow, and subcooling system 30 is capable of providing a correspondingly greater thermal performance benefit in applications having large cooling demands and increased or continuous water flow demands.

Figure 1B:
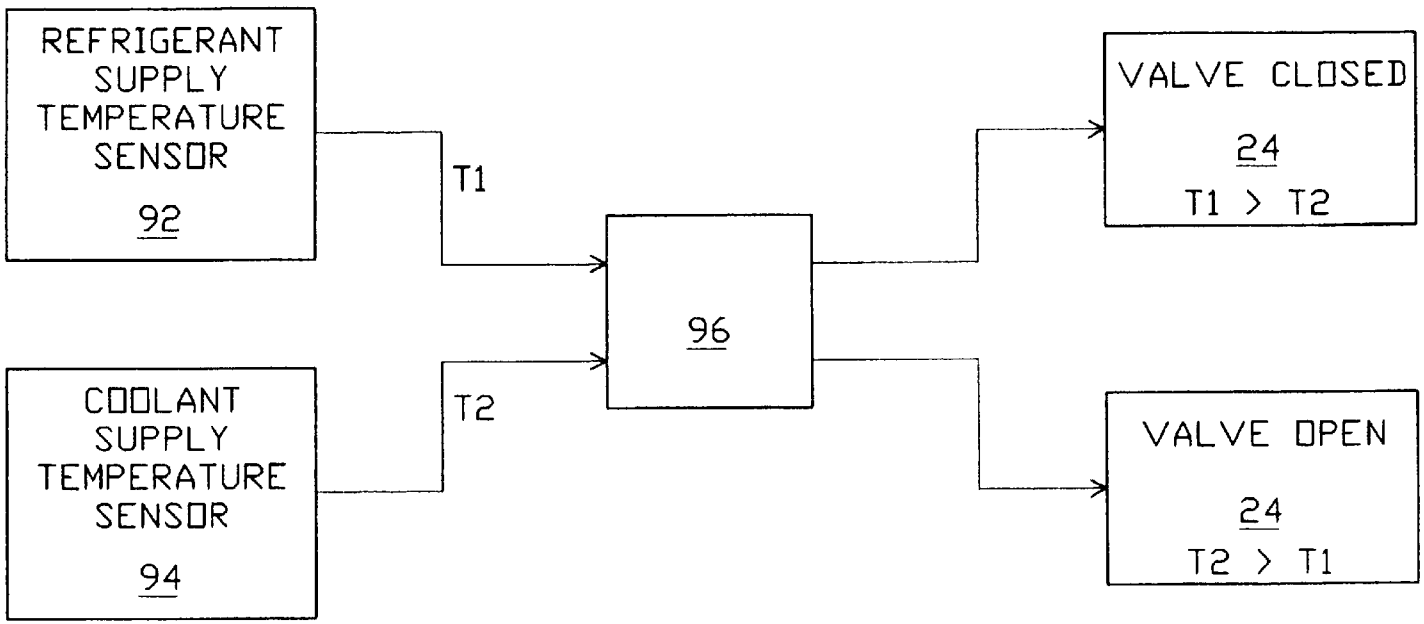
FIG. 1B is a schematic drawing of a cooling device with a subcooling system according to a preferred embodiment.

Referring to FIGS. 1A and 1B, a control system for subcooling system 30 is provided according to a preferred embodiment. Control system 90 includes a sensor 92 (e.g. thermocouple, resistance temperature device (RTD), etc.) for monitoring the temperature of the liquid refrigerant downstream of receiver 16, and a sensor 94 (e.g. thermocouple, RTD, etc.) for monitoring the temperature of the coolant supply to subcooler 34. Sensors 92 and 94 provide a signal representative of the refrigerant supply temperature (T1) for subcooler 34 and the coolant supply temperature (T2) for subcooler 34 respectively to a control device 96. When T1 is greater than T2, control system 96 provides a signal to close valve 24 and direct the refrigerant flow through subcooler 34. When T1 is less than T2, control system 96 provides a signal to open valve 24 to bypass or divert the refrigerant flow around subcooler 34. In an alternative embodiment, other cooling system parameters may be monitored or control system signals may be used to regulate the flow of coolant or refrigerant to the subcooler.

In another preferred embodiment, the subcooling system 30 may be provided as a generally self-contained modular unit (shown schematically as unit 31 adapted for use with an existing cooling device). Subcooling system 30, including subcooler supply line 32, heat exchanger 34, subcooler return line 36, bypass line 38, valve 24, sensor 92 and sensor 94, may be provided as a modular unit sized for, and having suitable connections (not shown) for, tie-in to an existing cooling system and for receiving a supply of coolant. Unit 31 may be used for retrofitting existing cooling devices, or as a design alternative for new cooling devices, where the addition of a subcooling system is desirable.

Referring to FIG. 2A a cooling device 110 with a subcooling system 130 is provided as part of a modular system 60 according to a preferred embodiment. The modular system 60 is capable of installation at any location where a supply of cold refrigerant is desired and a coolant supply is available. An enclosure (e.g. trailer, van, container, skid, etc.) houses a compressor 112, condenser 114, suitable refrigerant piping 122, and subcooler 134 and associated piping to provided a modular, mobile unit 62. The cooling device 110 may be provided with a receiver 116 in a preferred embodiment, however, a receiver may be omitted in alternative embodiments. Refrigerant piping 122 in mobile unit 62 includes suitable refrigerant piping portions 82 such as flexible hoses with connectors or couplings 84 for coupling to existing refrigerant piping portions 86 having connections 88 at any appropriate installation location 80 such as a supermarket or other commercial, institutional, agricultural or industrial location. In a particularly preferred embodiment, the mobile unit 62 includes a hot water device 146 (e.g. hot water heater, boiler, etc.) for providing a source of hot water to installation location 80. The hot water heater 146 receives a supply of warmed water from subcooler 34 to improve the thermal efficiency of hot water device 146 and to provide subcooling of the refrigerant for the cooling device. The mobile unit 60 has suitable supply piping 66 provided for connection to an external water supply source 140 to deliver a relatively cold supply of water to the coolant inlet of subcooler 134, and piping 68 to deliver warmed water from the coolant outlet of subcooler 134 through valve 148 (with valve 150 closed) to hot water device 146. Warmed water from subcooler 134 may also be directed to any other warmed water application 152 at installation location 80 by closing valve 148 and opening valve 150. Suitable piping portions 72 such as flexible hoses and, connectors or couplings 74 for subcooling system 130 are provided to deliver the cold water from source 140 at installation location 80, and to deliver the hot water from hot water device 146 to a receiving source 154, and to deliver warmed water from subcooler 134 to a warm water application 152 at installation location 80.

Figure 2B:
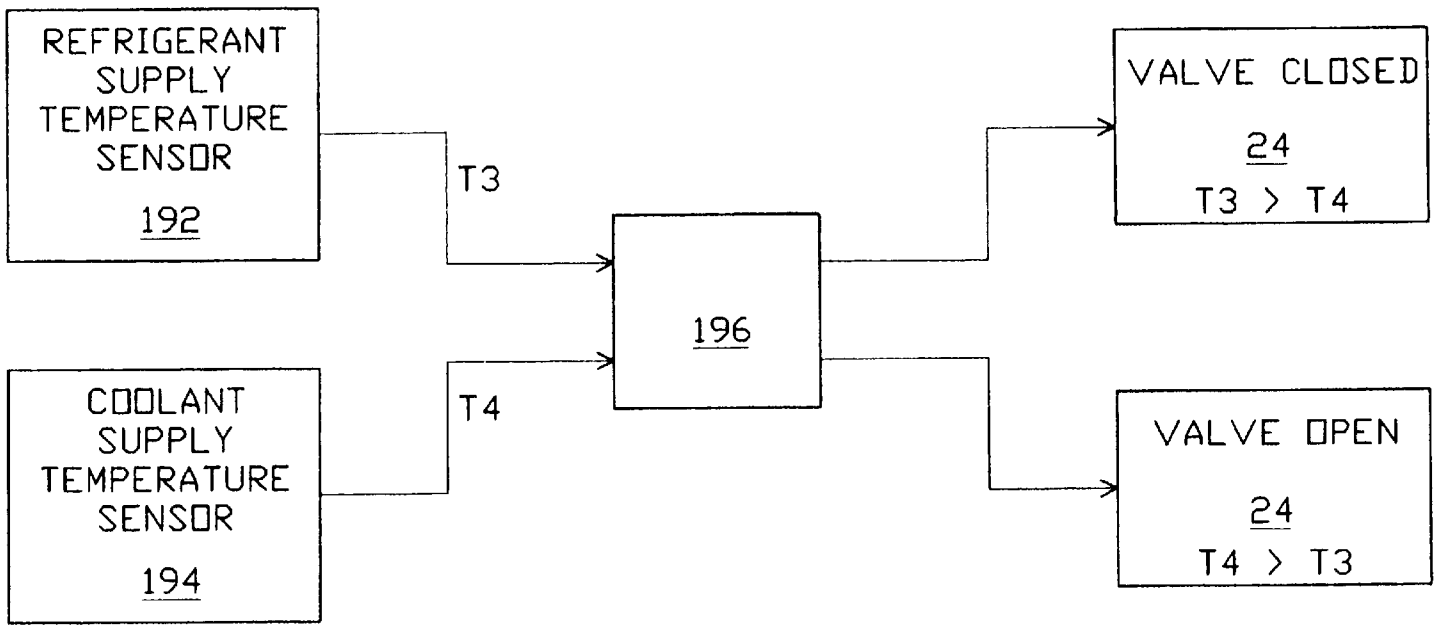
FIG. 2B is a schematic drawing of a cooling device with a subcooling system according to another preferred embodiment.

Referring to FIGS. 2A and 2B, a control system for subcooling system 130 is provided according to a preferred embodiment. Control system 190 includes a sensor 192 (e.g. thermocouple, resistance temperature device (RTD), etc.) for monitoring the temperature of the liquid refrigerant downstream of condenser 114 or receiver 116 if provided), and a sensor 194 (e.g. thermocouple, RTD, etc.) for monitoring the temperature of the coolant supply to subcooler 134. Sensors 192 and 194 provide a signal representative of the refrigerant supply temperature (T3) for subcooler 134 and the coolant supply temperature (T4) for subcooler 134 respectively to a control device 196. When T3 is greater than T4, control system 196 provides a signal to close valve 124 and direct the refrigerant flow through subcooler 134. When T3 is less than T4, control system 196 provides a signal to open valve 124 to bypass or divert the refrigerant flow around subcooler 134.

It is important to note that the construction and arrangement of the elements of the cooling device with subcooling system provided herein are illustrative only. Although only a few exemplary embodiments of the present invention have been described in detail in this disclosure, those skilled in the art who review this disclosure will readily appreciate that many modifications are possible in these embodiments (such as variations in features such as components, coolant compositions, water supply sources, uses for the warmed water or devices for receiving the warmed water, orientation and configuration piping, location of components and sensors of the subcooling and control systems; variations in sizes, structures, shapes, dimensions and proportions of the components of the system, use of materials, colors, combinations of shapes, etc.) without materially departing from the novel teachings and advantages of the invention. For example, the cooling device with subcooling system, and the modular subcooling system, may be adapted for use in a wide variety of residential, commercial, institutional, industrial or agricultural applications, including supermarkets, food processing facilities, hotels, cold storage facilities, ice skating arenas, etc. and may be provided in any number, size, orientation and arrangement to suit a particular cooling system and hot water supply needs of the installation location. Further, it is readily apparent that variations of the subcooling system and its components and elements may be provided in a wide variety of types, shapes, sizes and performance characteristics, or provided in locations external or partially external to the refrigeration system. Accordingly, all such modifications are intended to be within the scope of the inventions.

The order or sequence of any process or method steps may be varied or resequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A cooling device with a subcooling system, the cooling device having a closed loop refrigerant cycle containing a refrigerant, comprising:

a heat exchanger communicating with the closed loop refrigerant cycle and communicating with a fluid;

the heat exchanger configured to selectively receive and cool the refrigerant from the closed loop refrigerant cycle and configured to receive and warm the fluid when a first temperature of the refrigerant is greater than a second temperature of the fluid;

a valve operable to divert the refrigerant away from the heat exchanger when the first temperature is less than the second temperature; and a fluid receiving device configured to receive the fluid from the heat exchanger.

2. The cooling device of claim 1, wherein the fluid is water.

3. The cooling device of claim 1, wherein the valve is a bypass valve for selectively directing the refrigerant to the heat exchanger when the bypass valve is in a first position and for selectively directing the refrigerant away from the heat exchanger when the bypass valve is in a second position.

4. The cooling device of claim 3, further comprising a control system configured to receive a signal representative of the first temperature of the refrigerant and a signal representative of the second temperature of the fluid and provide an operating signal to operate the position of the bypass valve between the first position and the second position.

5. The cooling device of claim 1, wherein the heat exchanger is a plate-type heat exchanger.

6. The cooling device of claim 1, wherein the fluid receiving device is a hot water heater.

7. The cooling device of claim 1, wherein the refrigerant is a saturated liquid refrigerant.

8. The cooling device of claim 1, wherein the heat exchanger is enclosed within a transportable unit and configured for use at an installation location.

9. The cooling device of claim 8, wherein the installation location is a supermarket.

10. The cooling device of claim 1, wherein the cooling device is one of a refrigerator, a freezer, a temperature controlled display case and an air conditioner.

11. A method of subcooling a refrigerant in a cooling device having a closed loop cooling cycle, the method comprising:

connecting a heat exchanger to a condensed liquid refrigerant portion of the closed loop cooling cycle;

providing a fluid from a fluid source in thermal communication with the heat exchanger;

directing the refrigerant to the heat exchanger to cool the refrigerant and warm the fluid when a first temperature of the refrigerant is greater than a second temperature of the fluid;

bypassing the refrigerant away from the heat exchanger when the first temperature of the refrigerant is less than the second temperature of the fluid; and routing the fluid from the heat exchanger to a fluid receiving device.

12. The method of claim 11, further comprising monitoring the first temperature of the refrigerant temperature and monitoring the second temperature of the fluid.

13. The method of claim 12, further comprising providing a control device configured to receive a signal representative of the first temperature of the refrigerant and a signal representative of the second temperature of the fluid.

14. The method of claim 13, further comprising operating a valve when the signal representative of the refrigerant temperature and the signal representative of the fluid temperature satisfy a predetermined relationship.

15. A cooling system having a subcooling device, the cooling system having a refrigerant in a closed loop refrigeration cycle, comprising:

a heat exchanger having a refrigerant inlet configured to receive the refrigerant from the closed loop refrigeration cycle and a refrigerant outlet configured to return the refrigerant in a cooled state to the closed loop refrigeration cycle;

the heat exchanger further including a fluid inlet configured to receive a fluid from a fluid source and a fluid outlet configured to discharge the fluid in a warmed state to a warm fluid usage application; and a control system operable to direct the refrigerant through the heat exchanger when a refrigerant temperature at the refrigerant inlet is greater than a fluid temperature at the fluid inlet and to bypass the refrigerant around the heat exchanger when the refrigerant temperature is less than the fluid temperature.

16. The cooling system of claim 15, further comprising at first temperature monitoring device configured to provide a signal representative of the refrigerant temperature and a second temperature monitoring device configured to provide a signal representative of the fluid temperature.

17. The cooling system of claim 15 further comprising a valve operable to direct a flow of the refrigerant to the heat exchanger.

18. The cooling system of claim 15 wherein the fluid source is a municipal water supply.

19. The cooling of claim 15, wherein the warm fluid usage application is one of a water heater, a radiator, an agricultural watering device and a landscape watering device.

* * * * *

UNITED STATES PATENT AND TRADEMARK OFFICE

CERTIFICATE OF CORRECTION

PATENT NO. : 6,708,511 B2
DATED : March 23, 2004
INVENTOR(S) : Jon Scott Martin

It is certified that error appears in the above-identified patent and that said Letters Patent is hereby corrected as shown below:

Title page,
Item [57], ABSTRACT,
Delete lines 2-18 and substitute:

-- A subcooling system is provided for a cooling device that includes a closed loop refrigerant cycle containing a refrigerant, a heat exchanger communicating with the closed loop refrigerant cycle and communicating with a fluid, the heat exchanger configured to selectively receive and cool the refrigerant from the closed loop refrigerant cycle when the refrigerant temperature is greater than the fluid temperature, and a fluid receiving device configured to receive the fluid that is warmed in the heat exchanger. A modular system for providing a refrigerant to a cooling device at an installation location includes a transportable enclosure having at least one compressor, a condenser and a piping system for conveying the refrigerant in a closed loop cycle, where the piping system includes portions configured to be coupled to the cooling device at the installation location. --

Signed and Sealed this

Fourth Day of January, 2005

JON W. DUDAS
*Director of the United States Patent and Trademark Office*